US005685746A

United States Patent [19]

Maejima

[11] Patent Number: 5,685,746

[45] Date of Patent: Nov. 11, 1997

[54] FEMALE TERMINAL FOR RECEIVING PLATE-SHAPED MALE TERMINAL

[75] Inventor: Toshiro Maejima, Shizuoka-ken, Japan

[73] Assignee: Yazaki Corporation, Tokyo, Japan

[21] Appl. No.: 439,104

[22] Filed: May 11, 1995

[30] Foreign Application Priority Data

May 11, 1994 [JP] Japan ..... 6-097169

[51] Int. Cl.[6] ..... H01R 13/187

[52] U.S. Cl. ..... 439/845; 439/852; 439/857

[58] Field of Search ..... 439/833, 839, 439/842, 843, 845, 851, 852, 856, 857, 862

[56] References Cited

U.S. PATENT DOCUMENTS

| | | | |
|---|---|---|---|
| 4,238,140 | 12/1980 | Cairns et al. | 439/595 |
| 4,540,235 | 9/1985 | Lolic | 439/839 |
| 4,564,259 | 1/1986 | Vandame | 439/852 |
| 5,188,545 | 2/1993 | Hass et al. | 439/851 |
| 5,334,058 | 8/1994 | Hotea | 439/851 |
| 5,360,356 | 11/1994 | May et al. | 439/851 |
| 5,413,495 | 5/1995 | Takeuchi et al. | 439/852 |
| 5,468,163 | 11/1995 | Egenolf | 439/851 |

FOREIGN PATENT DOCUMENTS

| | | |
|---|---|---|
| 57-29074 | 2/1982 | Japan . |
| 5-26312 | 4/1993 | Japan . |

*Primary Examiner*—Neil Abrams
*Assistant Examiner*—Brian J. Biggi
*Attorney, Agent, or Firm*—Wigman, Cohen, Leitner & Myers, P.C.

[57] ABSTRACT

A female terminal for receiving a plate-shaped male terminal includes a terminal body consisting of a wire connection portion and an electrical connection portion to connect with the the male terminal. The electrical connection portion has a pair of opposing elastic plates for elastically pinching the male terminal therebetween. The female terminal further includes a protective member for covering the electrical connection portion. The protective member has an opening defined at a front portion thereof and slits formed on sidewalls of the protective member. When connecting the inclined male terminal with the female terminal, the leading end of the male terminal is initially introduced into the protective member through either one of the slits. By pivotal movement of the male terminal thereafter, the male terminal can be connected to the female terminal so as to be in alignment therewith.

8 Claims, 3 Drawing Sheets

FEMALE TERMINAL FOR RECEIVING PLATE-SHAPED MALE TERMINAL

BACKGROUND OF THE INVENTION

The present invention relates to a female terminal which is connected to a plate-shaped male terminal.

A conventional lever-type of connector assembly consists of a male connector and a female connector mounted on the male connector so as to pivot about a fulcrum arranged on one end thereof. In this connector assembly, a female terminal is accommodated in the female connector and a plate-shaped male terminal is accommodated in the male connector. In operation, when the female connector is rotated to the male connector fixed on a panel, the plate-shaped male terminal is connected to the female terminal. In an initial stage of the connection, the male terminal is engaged with the female terminal so as to incline with respect to a longitudinal axis of the female connector by a predetermined degree. Then, at the end stage of engagement of the male connector with the female connector, the male terminal is connected in substantial alignment with the female terminal.

This kind of female terminal, to which the plate-shaped male terminal is connected by its rotating, is disclosed in Japanese Examined Patent Publication (Kokoku) No.5-26312.

In the above Publication, the female terminal is provided at a rear side thereof with a wire connection portion to which an electrical wire is connected. Further, the female terminal has an electrical connection portion consisting of a pair of elastic plates formed at the front side. A leading end of each elastic plate is bent outwardly to form a guide portion for facilitating insertion of the male terminal thereinto. With the arrangement, when the male terminal is rotatingly engaged into the female terminal, then the male terminal can be guided by the guide portions and inserted between the pair of elastic plates of the female terminal securely.

In the above female terminal, however, the elastic plates and their guide portions are subject to external force in the process of transporting the female terminal, assembling it with a wire-harness, inspecting the connector assembly and so on. Therefore, there is caused a problem that, if such an external force is applied thereon, the elastic plates are easily deformed.

To solve the above problem, U.S. Pat. No. 5,188,545 and Japanese Unexamined Utility Model Publication (Kokai) No.57-29074 disclose a female terminal in which the pair of elastic plates are protected by a rectangular shaped sleeve, whereby the plates can be prevented from being deformed and broken by an external force.

In either of the female terminals disclosed in these publications, however, respective front portions of the elastic plates are not covered with the sleeve at all. Therefore, in case of inspecting the conduction of the female terminal by a terminal inspection tool and if a conduction inspecting pin comes into contact with the elastic plates by accident, they are subject to the external force directly thereby to cause them to be deformed, so that there is the possibility that defective contact will be raised.

SUMMARY OF THE INVENTION

It is therefore an object of the present invention to provide a female terminal capable of preventing the pair of elastic plates from being deformed.

The object of the invention described above can be accomplished by a female terminal for receiving a plate-shaped male terminal, comprising:

a terminal body consisting of a wire connection portion arranged at a rear section thereof to connect with a terminal end of an electrical wire and an electrical connection portion arranged at a front section of the terminal body to connect with the plate-shaped male terminal, the electrical connection portion including a pair of opposing elastic plates for elastically pinching the male terminal therebetween; and a protective member for covering the electrical connection portion of the terminal body, the protective member being provided at a front portion thereof for covering leading ends of the elastic plates with an opening through which the plate-shaped male terminal is to be inserted into the electrical connection portion;

wherein the protective member is provided on both sidewalls thereof with slits which are formed so as to communicate with the opening and to extend along opposing surfaces of the elastic plates.

With the arrangement of the invention, when the male terminal is rotatingly connected with the female terminal, the leading end of the male terminal is initially inserted between the pair of elastic plates through either of the slits of the protective member and, finally, the male terminal is inserted into the electrical connection portion through the opening of the protective member. Consequently, the male terminal can be connected to the female terminal so as to be in alignment therewith. Further, since the pair of elastic plates are covered with the protective member, there is no possibility that an external force is applied to the plates.

In the present invention, preferably, the protective member is provided at the front portion with flattened portions which are in the vicinity of the opening.

With the above mentioned arrangement, when inspecting the conductive condition of the male and female terminals by using a conductive inspection tool, a conductive inspecting pin thereof is brought into contact with either one of the flattened portions. Under such a situation, since any external force is not applied on the guide portions, it is possible to prevent the elastic plates from being deformed.

In the present invention, preferably, respective front portions of the elastic plates are bent outwardly so as to be apart from each other, thereby providing terminal guide portions and the leading ends of the elastic plates are covered with said flattened portions, respectively.

With the arrangement mentioned above, even if the inserting direction of the male terminal is somewhat deviated from the female terminal, the leading end of the male terminal can be guided between the pair of elastic plates due to the terminal guide portions being bent outwardly. Further, since the leading ends of the elastic plates are covered with the flattened portions, respectively, the external force is not applied on the terminal guide portions thereby to protect them securely.

More preferably, the electrical connection portion further includes side plates formed on both lateral sides of the elastic plates. In this case, since the leading end of the male terminal after insertion is interposed between the side plates, the male terminal can be accommodated in the protective member more stably.

Preferably, the protective member has at least one engaging projection formed On an inner wall thereof and the electrical connection portion of the terminal body has at least one recess to engage with the engaging projection(s).

With the arrangement, it is possible to prevent the protective member from detaching from the terminal body by accident.

The object and features of the present invention will become more fully apparent from the following description and appended claims taken in conjunction with the accompanying drawings.

DESCRIPTION OF THE PREFERRED EMBODIMENT

One embodiment of the present invention is now described with reference to the drawings.

Figure 1:
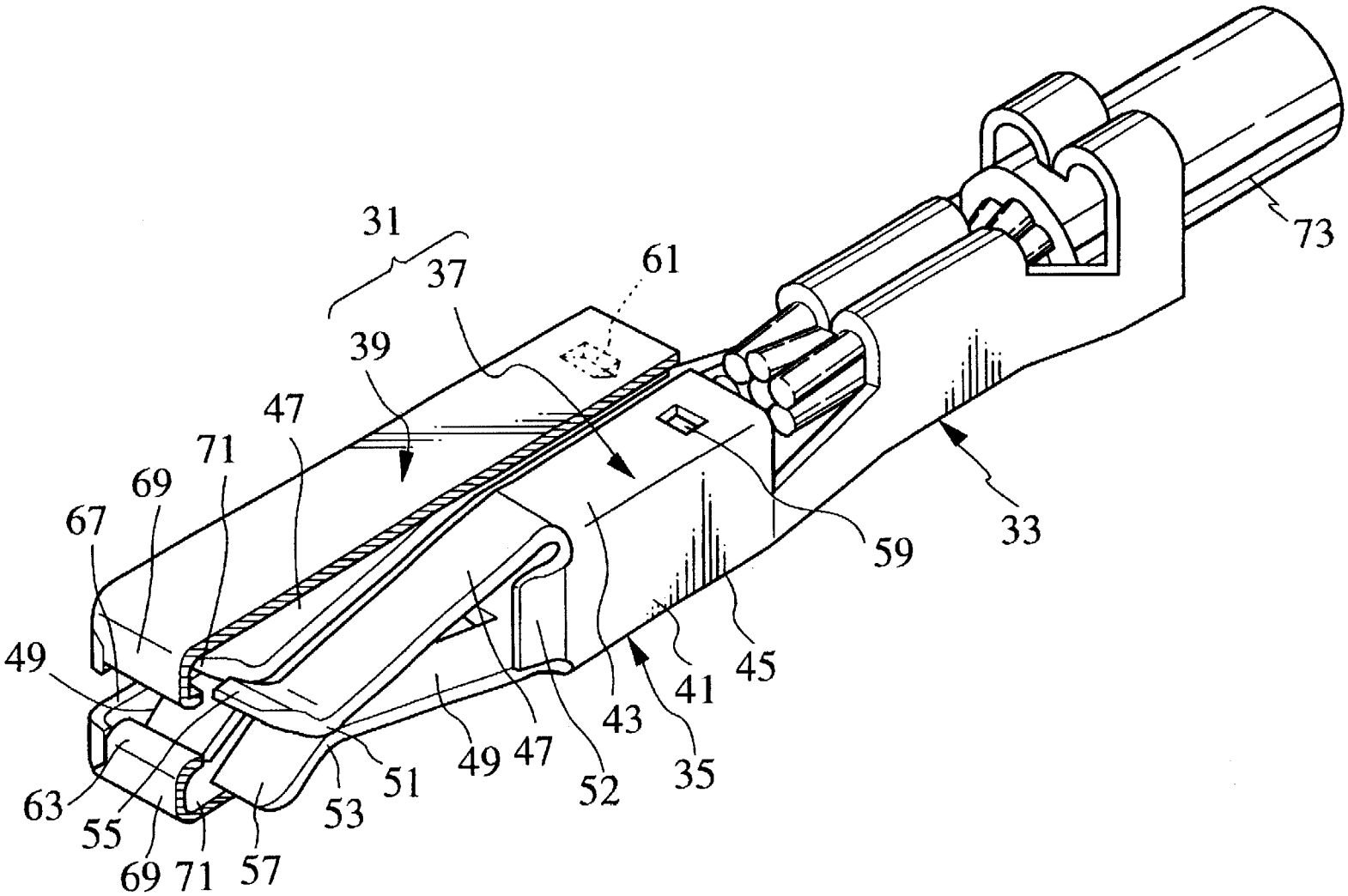
FIG. 1 is a perspective view of a female terminal in accordance with to an embodiment of the present invention, in which a part of the female terminal is cut away to show its internal structure clearly.
Figure 2:
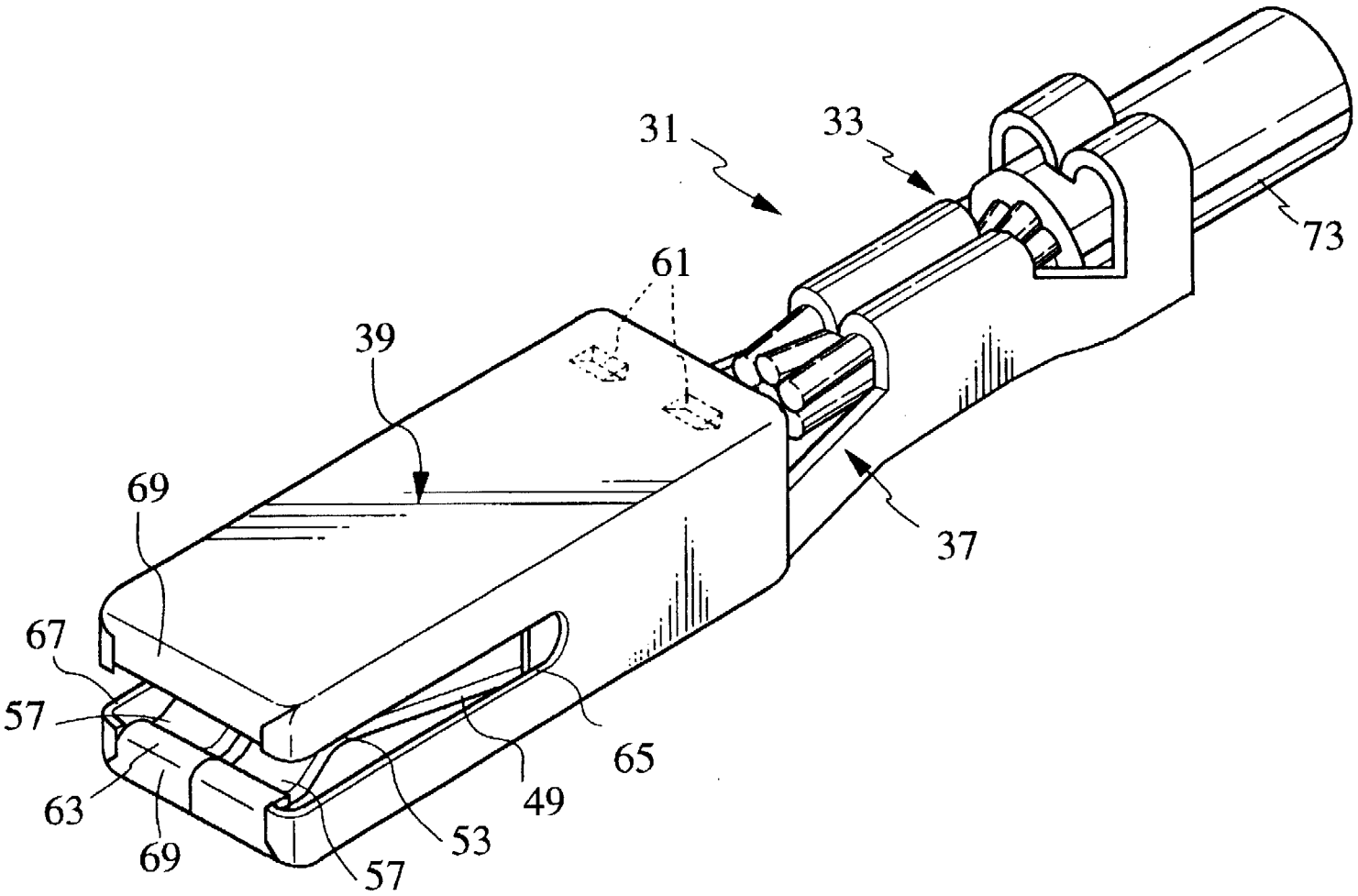
FIG. 2 is a perspective view of the whole female terminal of FIG. 1.
Figure 3A:
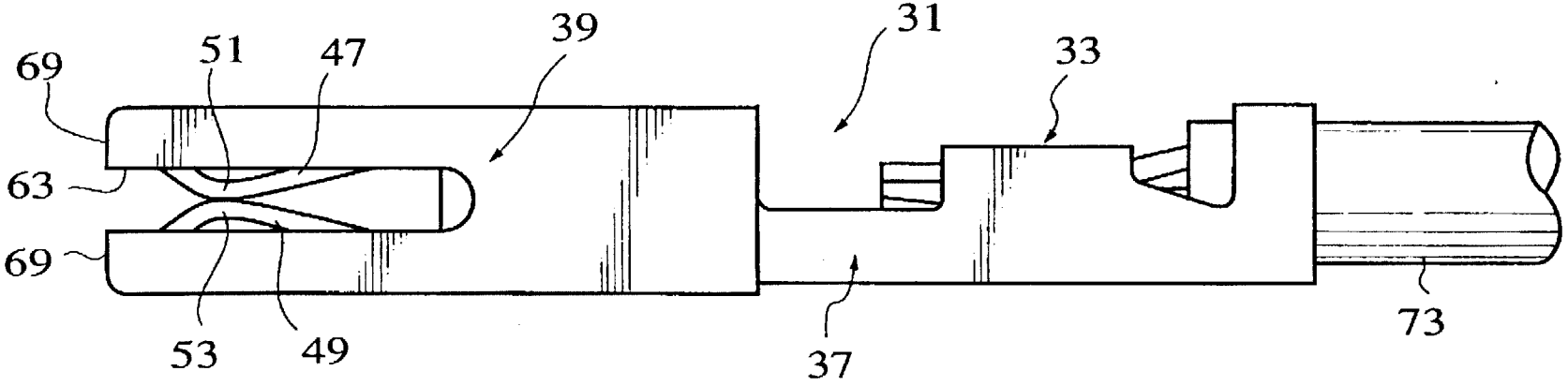
FIG. 3A is a side view of the female terminal of FIG. 1.
Figure 3B:
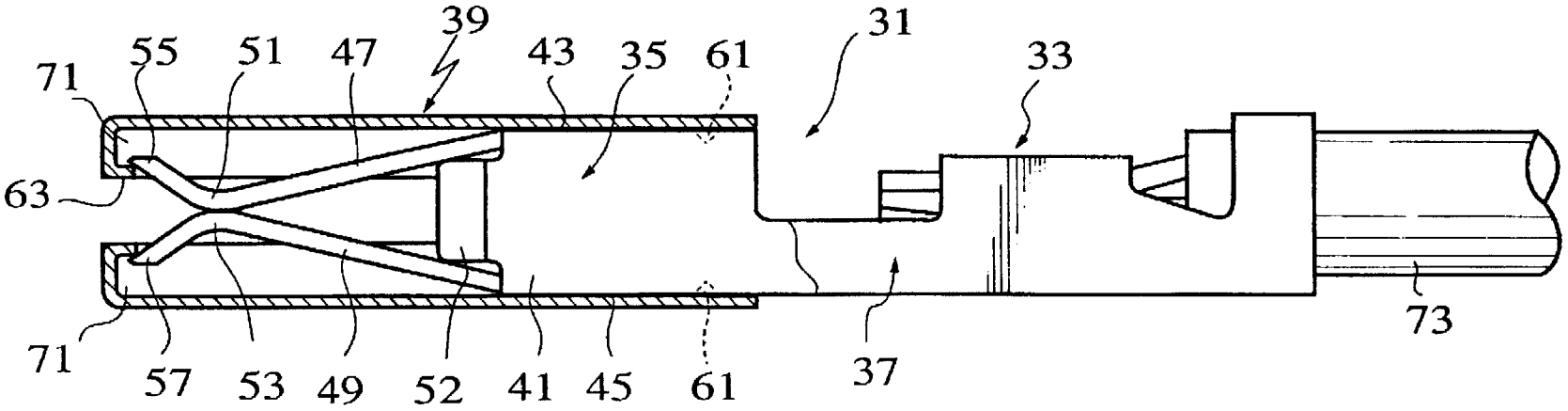
FIG. 3B is a partially cross sectional view showing an interior of the electrical connection portion of the female terminal of FIG. 1.

FIG. 1 is a perspective view of a female terminal 31 according to an embodiment of the present invention, in which a part of the female terminal 31 is cut away to show its internal structure clearly. FIG. 2 is a perspective view of the whole female terminal 31. In addition, FIG. 3A is a side view of the female terminal 31 and FIG. 3B is a cross sectional view showing an interior of electrical connection portion of the terminal 31.

As shown in FIGS. 1 to 3B, the female terminal 31 consists of a terminal body 37 and a protective member 39. The terminal body 37 is provided at a rear section thereof with a wire connection portion 33 which is connected to a terminal end of a wire 73. On the other hand, the terminal body 37 is provided at a front section thereof with an electrical connection portion 35 for elastically pinching a not-shown plate-shaped male terminal. The protective member 39 is adapted so as to cover the electrical connection portion 35.

The wire connection portion 33 is crimped to be connected with the terminal end of the wire 73. The electrical connection portion 35 has two pairs of elastic plates 47 and 49 provided on upper and lower sidewalls 43 and 45 of a rectangular-shaped base portion 41 which is bent so as to have a rectangular cross section. The respective elastic plates 47 and 49 are inclined inwardly from the sidewalls 43 and 45, respectively. The leading ends of the elastic plates 47 and 49 are bent in an arc so as to be directed outwardly. In the elastic plate 47, a depressed portion 51 formed in an arc abuts on another depressed portion 53 of the elastic plate 49, which is also formed in an arc. In the embodiment, respective portions which extend from the depressed portion 53 to the leading ends constitute terminal guide portions 55 and 57. On the lateral sides of the Juxtaposed elastic plates 47 and 49, two side plates 52 and 52 (only one shown in the figure) are formed adjacent to the base portion 41 to hold the inserted male terminal stably. The rectangular-shaped base portion 41 and both elastic plates 47 and 49 are covered with a protective member 39.

As shown in FIG. 2, the tubular protective member 39 having a rectangular cross section has the pair of elastic plates 47 and 49 of the terminal body 37 inserted thereinto. By engaging projections 61 and 61 formed on an inner wall of the protective member 39 into recesses 59 and 59 formed on the upper and lower sidewalls 43 and 45 of the base portion 41, the protective member 39 can be attached on the terminal body 37. At the front end of the protective member 39, a terminal insertion opening 63 is defined transversely. Further, on sidewalls 38, 38' of the protective member 39, slits 65 and 67 are formed so as to communicate with the opening 63 and to extend along opposing surfaces of the elastic plates 47 and 49. The vertical dimension of the opening 63, i.e. a width thereof, is established to be somewhat larger than a thickness of the plate-shaped male terminal elastically supported between the pair of the elastic plates 47 and 49, and each width of the slits 65 and 67 is established equal to the width of the opening 63.

The front ends of the protective member 39 defining the above opening 63 are bent inwardly, forming flattened portions 69 and 69 on an exterior side thereof and accommodation portions 71 and 71 on an interior side of the opening 63. Respectively accommodated in the accommodation portions 71 and 71 are the terminal guide portions 55 and 57 which are formed at leading ends of the elastic plates 47 and 49, respectively.

When connecting the male terminal to the so-constructed female terminal 31, the male terminal is inserted between the pair of elastic plates 47 and 49 under condition that the male terminal is not in alignment with the female terminal 31. In this way, when the male terminal under the inclined condition is approached to the female terminal Sl, the leading end of the male terminal is introduced into the protective member 39 through a portion, e.g. a boundary portion between the slits 85 and the opening 83. Then, being guided by the terminal guide portions 55 and 57 initially, the male terminal is inserted between the depressed portions 51 and 58 of the pair of elastic plates 47 and 49. Under such a condition, the male terminal is pivotably interposed between the pair of elastic plates 47 and 49. Therefore, in the process of further inserting, the male terminal is pivotted thereby to be be in alignment with the female terminal 31. As a consequence, the male terminal is elastically supported by the electrical connection portion 35 while the rear portion of the male terminal is brought into the opening 63, whereby the electrical connection between the male terminal and female terminal 31 can be attained.

According to the embodiment, since the pair of elastic plates 47 and 49 are covered with the protective member 39, the plates 47 and 49 can be protected from any external force in transporting and assembling with the wire harness, so that there is no possibility of being deformed.

In addition, since the protective member 9 in accordance with the embodiment is provided in the vicinity of the opening 83 with the flattened portions 89 and 89, the conductive inspection can be performed by contact of the not-shoE conductive inspecting pin of the conductive inspection tool with the flattened portion 89. Thus, since any external force is not applied on the guide portions 55 and 57, it is possible to prevent the elastic plates 47 and 49 from being deformed.

Furthermore, according to the embodiment, since the terminal guide portions 55 and 57 are respectively accommodated in the accommodation portions 71 and 71 arranged in the front interior of the protective member 9, no external force is applied to the portions 55 and 57 directly, whereby it is possible to protect the pair of elastic plates 47 and 49.

It should be understood that the female terminal 31 of the embodiment may be applicable to any other connector besides a lever-type connector.

Finally, it will be understood by those skilled in the art that the foregoing is a description of preferred embodiments of the disclosed structure, and that various changes and modifications may be made to the present invention without departing from the spirit and scope thereof.

What is claimed is:

1. A female terminal for receiving a plate-shaped male terminal, comprising:

a terminal body including a wire connection portion arranged at a rear section of said terminal body for connection with a terminal end of an electrical wire and an electrical connection portion arranged at a front section of said terminal body for connection with said plate-shaped male terminal, said electrical connection portion including a pair of opposing elastic plates for elastically pinching said male terminal therebetween; and a protective member engaged with said terminal body for covering said electrical connection portion of said terminal body, said protective member having a pair of sidewalls between which said elastic plates are arranged, and an opening formed at a front portion of said protective member;

wherein each of said sidewalls of said protective member has a free end disposed adjacent to said opening and provided with a flattened front edge portion, and wherein respective front portions of said elastic plates are bent outwardly so as to be apart from each other, thereby providing terminal guide portions for facilitating insertion of said male terminal between said elastic plates; and wherein each of said flattened front edge portions is bent toward said opening and inside of said opening so that said leading ends of said elastic plates are encircled and covered by said flattened front edge portions, respectively.

2. A female terminal for receiving a plate-shaped male terminal, as claimed in claim 1, wherein said electrical connection portion further includes side plates formed on both lateral sides of said elastic plates.

3. A female terminal for receiving a plate-shaped male terminal, as claimed in claim 2, wherein said protective member has at least one engaging projection formed on an inner wall thereof and said electrical connection portion of said terminal body has at least one recess formed on a wall thereof, and wherein said each engaging projection is engaged into said each recess when said terminal body is covered with said protective member.

4. A female terminal for receiving a plate-shaped male terminal, as claimed in claim 1, wherein said slits are formed with parallel edges and extend only partly along the length of the sidewalls of the protective member.

5. A female terminal for receiving a plate-shaped male terminal, as claimed in claim 4, wherein said slits have the same length.

6. A female terminal for receiving a plate-shaped male terminal, as claimed in claim 1, wherein the width of said slits is greater than the thickness of the plate-shaped male terminal.

7. A female terminal for receiving a plate-shaped male terminal, as claimed in claim 6, wherein each of said side plates has a forward edge, said slits extending toward said wire connection portion past the forward edge of said side plates.

8. A female terminal for receiving a plate-shaped male terminal, as claimed in claim 1, including side plates formed on said electrical connection portion on opposite sides of said elastic plates for stably holding the inserted plate shaped male terminal.

* * * * *